US006814126B1

(12) United States Patent
Lee

(10) Patent No.: US 6,814,126 B1
(45) Date of Patent: Nov. 9, 2004

(54) SHEET MEMBER IMPRESSION STRUCTURE FOR LABELING MACHINE

(75) Inventor: Chen Cheng Lee, Shindian (TW)

(73) Assignee: Taiwan Semiconductor Co., Ltd., Taipei (TW)

( * ) Notice: Subject to any disclaimer, the term of this patent is extended or adjusted under 35 U.S.C. 154(b) by 0 days.

(21) Appl. No.: 10/660,231

(22) Filed: Sep. 10, 2003

(51) Int. Cl.[7] ..... B32B 31/00
(52) U.S. Cl. ..... 156/581; 156/580
(58) Field of Search ..... 156/358, 556, 156/580, 581, 583.1, 583.3; 100/315, 193, 295

(56) References Cited

U.S. PATENT DOCUMENTS 3,861,512 A * 1/1975 Coriasco et al. ..... 400/162.2
5,379,692 A * 1/1995 Haug ..... 101/227
5,711,846 A * 1/1998 Alicea ..... 156/556
6,695,501 B2 * 2/2004 Nedblake et al. ..... 400/621

* cited by examiner

*Primary Examiner*—James Sells
(74) *Attorney, Agent, or Firm*—Pro-Techtor International Services

(57) ABSTRACT

A sheet member impression structure formed of a rod member and two sheet member impression devices is disclosed in which each sheet member impression device includes a casing slidably mounted on the rod member, an adjustment unit mounted inside the casing and partially extended out of the casing for operation by the user to adjust the position of the casing on the rod member, and a press member supported on the bottom side of a spring member inside the casing and forced by the spring member to press on a pressure board keeping a transferring sheet member smooth.

14 Claims, 9 Drawing Sheets

SHEET MEMBER IMPRESSION STRUCTURE FOR LABELING MACHINE

BACKGROUND OF THE INVENTION

1. Field of the Invention

The present invention relates to a labeling machine and, more specifically, to a sheet member impression structure for use in a labeling machine to keep a transferring sheet member smooth.

2. Description of the Related Art

FIG. 1 shows a pair of sheet member impression devices 1*a* mounted on a rod member 2*a* and locked by a respective tightening up screw 3*a* to impart a downward pressure to a pressure board 4*a*, keeping the sheet member Sa being transferred beneath the pressure board 4*a* smooth. The pitch between the sheet member impression devices 1*a* is determined subject to the size of the sheet member 5*a*. Each sheet member impression device 1*a* comprises a cylindrical casing 11*a*, a cap 12*a* located on the top side of the cylindrical casing 11*a*, a spring member 13*a* mounted inside the cylindrical casing 11*a*, and a pressure tip 14*a* provided at the bottom side of the spring member 13*a* and extended out of the bottom side of the cylindrical casing 11*a*. The cylindrical casing 11*a* has two axle holes 11*a* transversely aligned at two sides near the cap 12*a* and a bottom opening 112*a*. The diameter of the axle holes 11*a* fits the outer diameter of the rod member 2*a* so that the cylindrical casing 11*a* can be firmly secured to the rod member 2*a*. The diameter of the bottom opening 112*a* is smaller than the inner diameter of the cylindrical casing 11*a*. The pressure tip 14*a* passes through the bottom opening 112*a* to the outside of the cylindrical casing 11*a*. The spring member 13*a* is adapted to adjust downward pressure of the sheet member impression device 1*a*. The pressure tip 14*a* is pressed on the pressure board 4*a*, controlling smooth transfer of the sheet member 5*a*.

The sheet member impression devices 1*a* are spaced from each other at a distance so that a downward pressure can be evenly applied to the pressure board 4*a*, keeping the transferring sheet member 5*a* smooth. When a different size of sheet member is used, the pitch between the two sheet member impression devices 1*a* must be properly adjusted.

When adjusting the position of each sheet member impression device 1*a*, a tool, for example, a screwdriver shall be used to unfasten the tightening up screw 3*a*, for enabling the respective sheet member impression device 1*a* to be moved along the rod member 2*a* to the desired position. This pitch adjustment procedure is complicated.

Further, because the contact between each sheet member impression device 1*a* and the pressure board 4*a* is a point contact, downward pressure may not be evenly applied from the sheet member impression devices 1*a* to the pressure board 4*a*.

SUMMARY OF THE INVENTION

The present invention has been accomplished under the circumstances in view. It is the main object of the present invention to provide a sheet member impression device for labeling machine, which provides a line contact to apply a downward pressure to the pressure board in the labeling machine evenly, keeping the transferring sheet member smooth.

To achieve this and other objects of the present invention, the sheet member impression structure comprises a rod member, and two sheet member impression devices mounted on the rod member and respectively pressed on a pressure board to smooth a sheet member being transferred beneath the pressure board. Each sheet member impression device comprises a casing mounted on the rod member, the casing comprising an inside space, two through holes aligned at two sides in communication with the inside space and adapted to accommodate the rod member, a side opening, and a bottom hole; an adjustment unit mounted in the inside space inside the casing below the rod member and partially extended out of the side opening of the casing for operation by the user to adjust the position of the casing on the rod member; a spring member mounted in the inside space inside the casing below the adjustment unit; and a press member mounted in the inside space inside the casing and supported on a bottom side of the spring member and partially extended out of the bottom hole of the casing and forced by the spring member to press on the pressure board.

DETAILED DESCRIPTION OF THE PREFERRED EMBODIMENT

Figure 1:
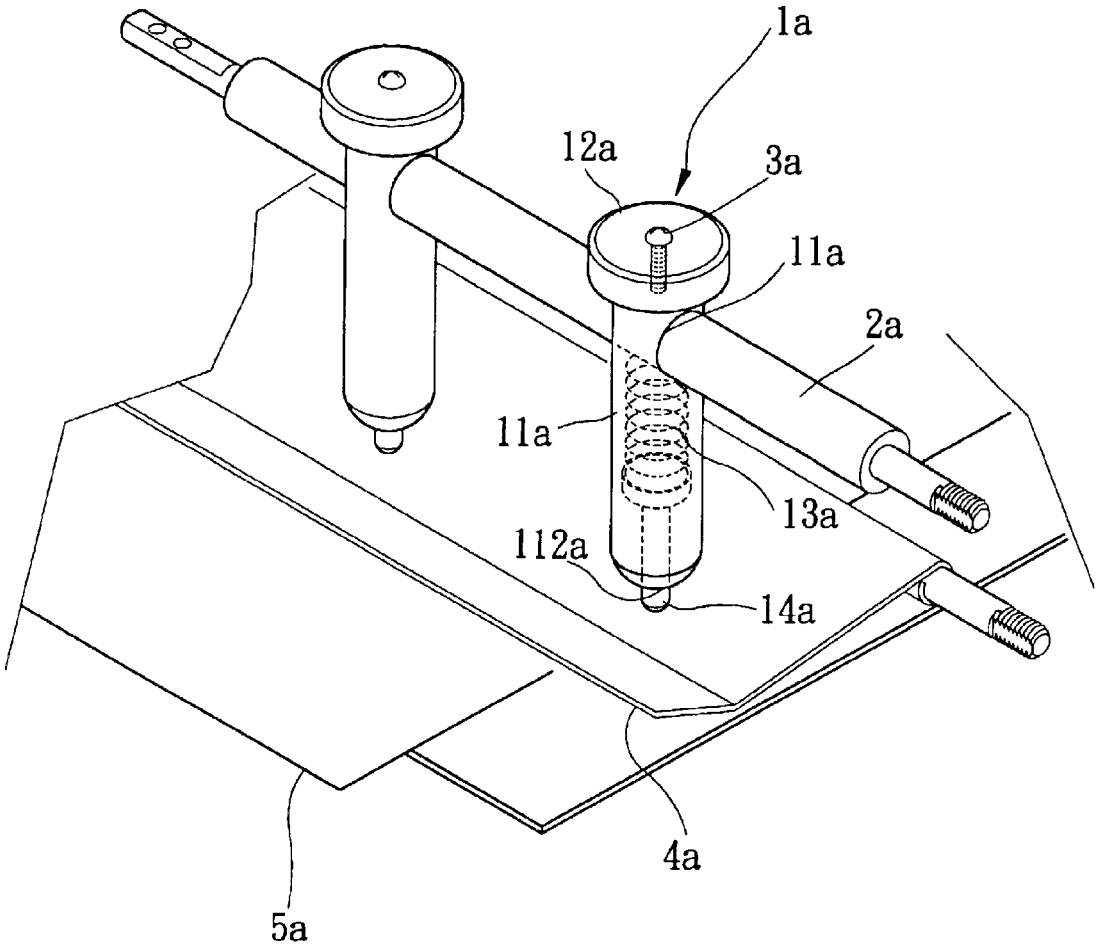
FIG. 1 is an elevational view of a part of a labeling machine, showing sheet member impression devices mounted on a rod member and pressed on a pressure board according to the prior art.
Figure 2:
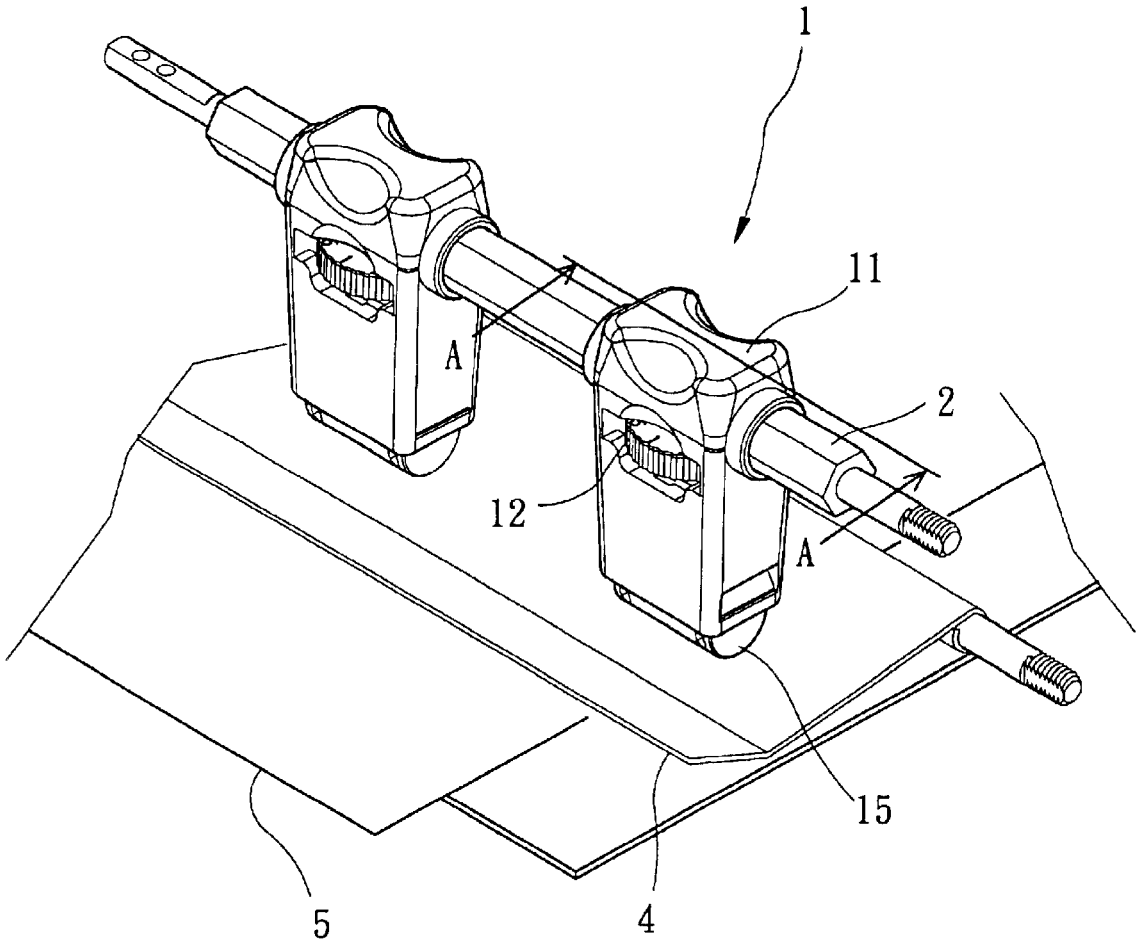
FIG. 2 is an elevational view of a part of a labeling machine, showing sheet member impression devices mounted on a rod member and pressed on a pressure board according to the present invention.

Referring to FIGS. 2~5, a sheet member impression structure is shown comprising a rod member 2, which has a plurality of locating holes 21 longitudinally arranged in a line, and two sheet member impression devices 1 mounted on the rod member 2 and respectively pressed on a pressure board 4 to smooth the sheet member 5 being transferred beneath the pressure board 4. Each sheet member impression device 1 is comprised of a casing 11, an adjustment unit, a retaining device 16, a spring member 14, and a press member 15.

Figure 3:
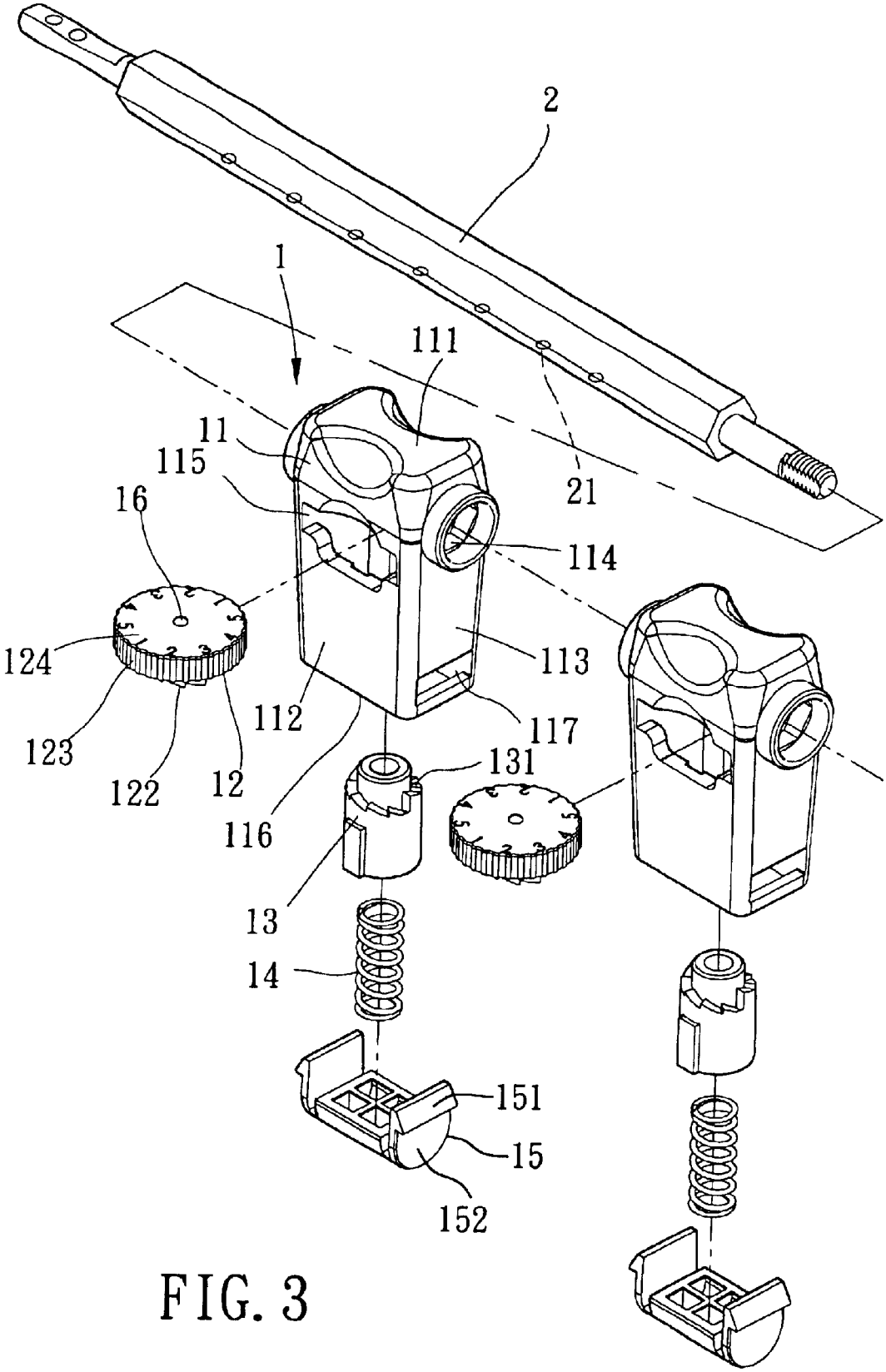
FIG. 3 is an exploded view of the sheet member impression devices shown in FIG. 2.
Figure 4:
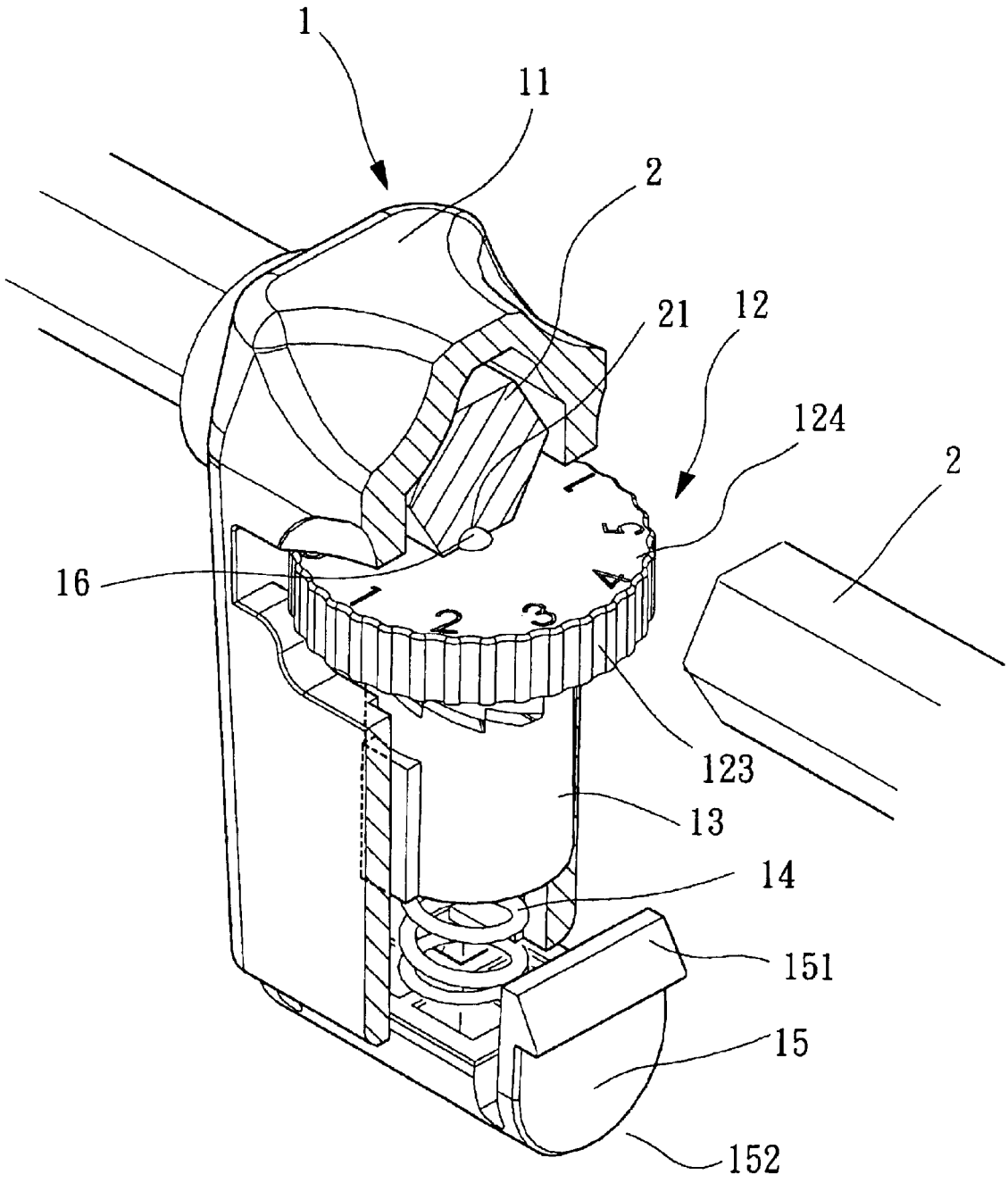
FIG. 4 is a cutaway view in an enlarged scale of a part of FIG. 2.
Figure 5:
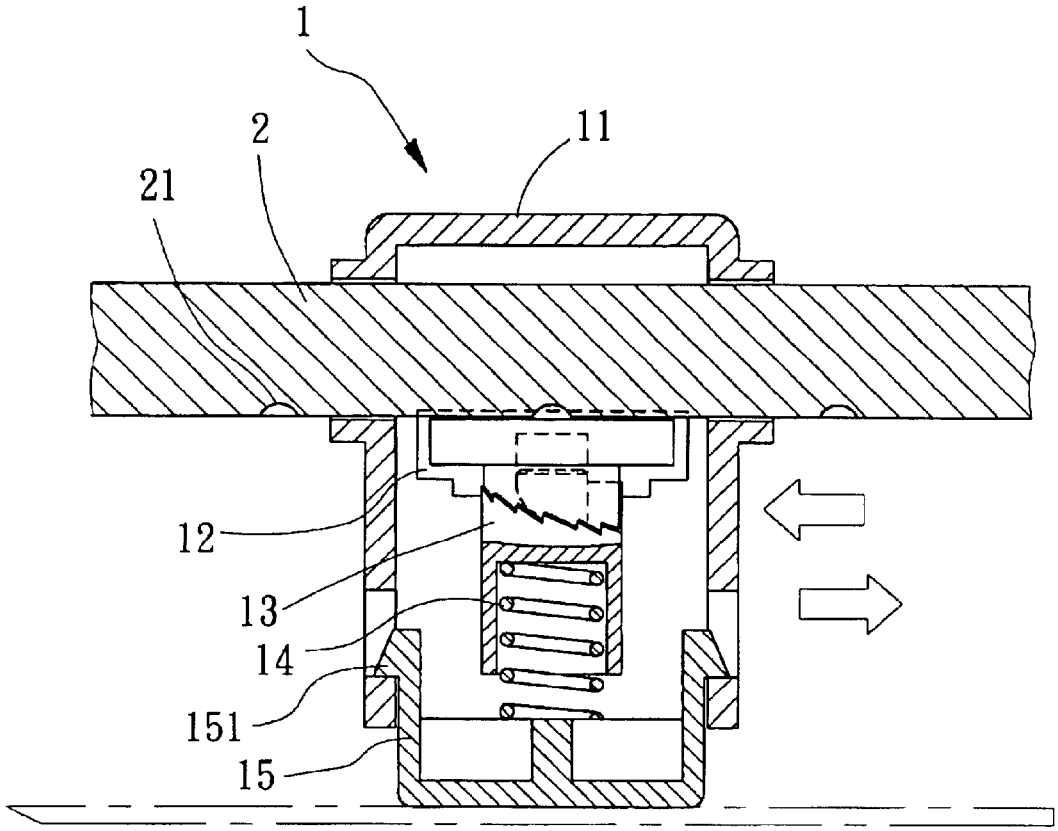
FIG. 5 is a sectional view in an enlarged scale taken along line 5—5 of FIG. 2.

Referring to FIGS. 3~5, the casing 11 is a hollow member having a horizontal top wall 111, two opposite vertical faces 112 at front and back sides thereof, two opposite vertical lateral sidewalls 113, two through holes 114 respectively formed in the two opposite vertical lateral sidewalls 113 adjacent the horizontal top wall 11 and horizontally aligned in a line in communication with the inside space thereof for accommodating the rod member 2, one opening 115 in one vertical face 112, two coupling holes 117 symmetrically disposed at two sides below the elevation of the through holes 114, and a bottom hole 116 in the bottom side thereof.

The adjustment unit is mounted inside the casing 11 below the rod member 2 and partially extended out of the opening 115 for operation by the user to adjust the operation height of the respective sheet member impression device 1. The adjustment unit is comprised of a first adjustment wheel 12 and a second adjustment wheel 13. The first adjustment wheel 12 is partially suspended inside the casing 11 below the rod member 2 and partially extended out of the casing 11 through the opening 115, having a ratchet 122 located on the bottom side, an embossed peripheral wall 123 for positive positioning of the user's finger to rotate the first adjustment wheel 12, and signs 124 on the top surface for indications of different operation heights. The second adjustment wheel 13 is a hollow wheel member mounted inside the casing 11 below the first adjustment wheel 12, having a top ratchet 131 meshed with the ratchet 122 of the first adjustment wheel 12.

The retaining device 16 is provided between the adjustment unit and the rod member 2 and adapted to selectively lock the respective sheet member impression device to one of the locating holes 21 of the rod member 2. According to the present preferred embodiment, the retaining device 16 is a spring-supported steel ball embedded in the center of the top surface of the first adjustment wheel 12 and partially protruding over the top surface of the first adjustment wheel 12.

Figure 6:
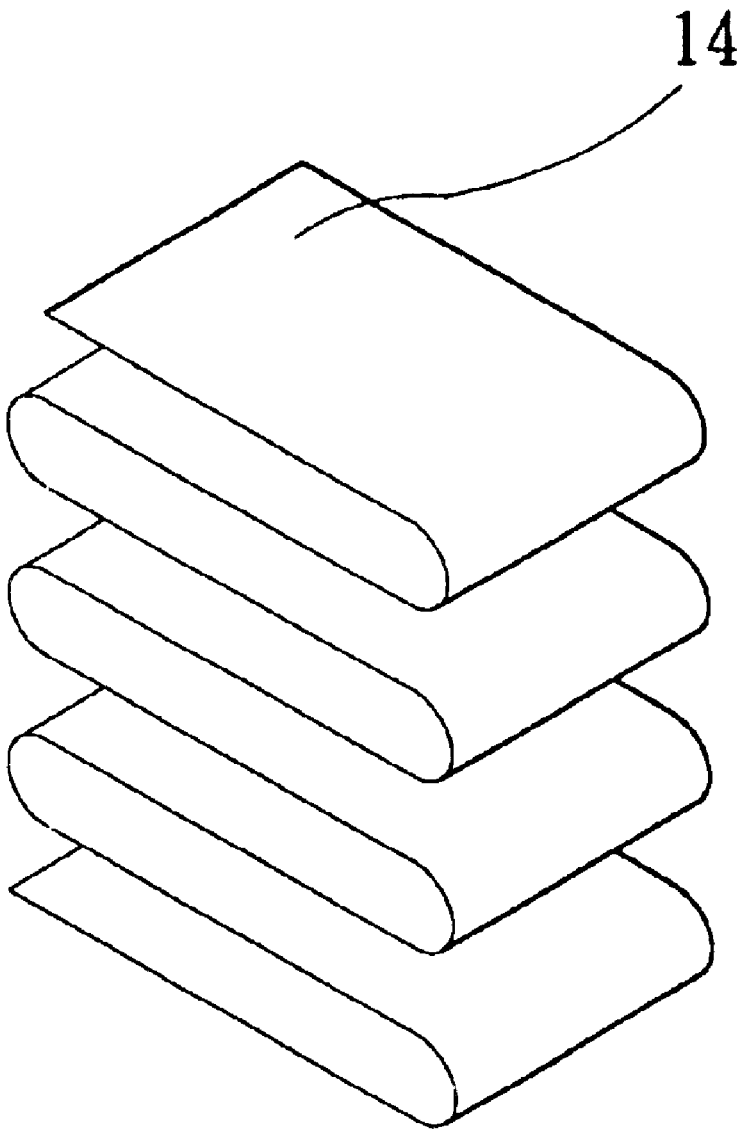
FIG. 6 is an elevational view of a continuously S-shaped spring leaf for use in the sheet member impression device according to the present invention.

The spring member 14 is mounted inside the second adjustment wheel 13, and adapted to impart a downward pressure to the press member 15. The spring member 14 can be a compression spring (see FIGS. 2~5), or a continuously S-shaped spring leaf (see FIG. 6).

The press member 14 is vertically movably coupled to the casing 11 and forced vertically downwards against the pressure board 4 by the spring member 14, comprising two coupling portions 151 symmetrically disposed at two sides and respectively loosely coupled to the coupling holes 117 of the casing 11, and a bottom contact wall 152 disposed in contact with the pressure board. The bottom contact wall 152 is a cambered surface for line contact with the pressure board 4.

Figure 7:
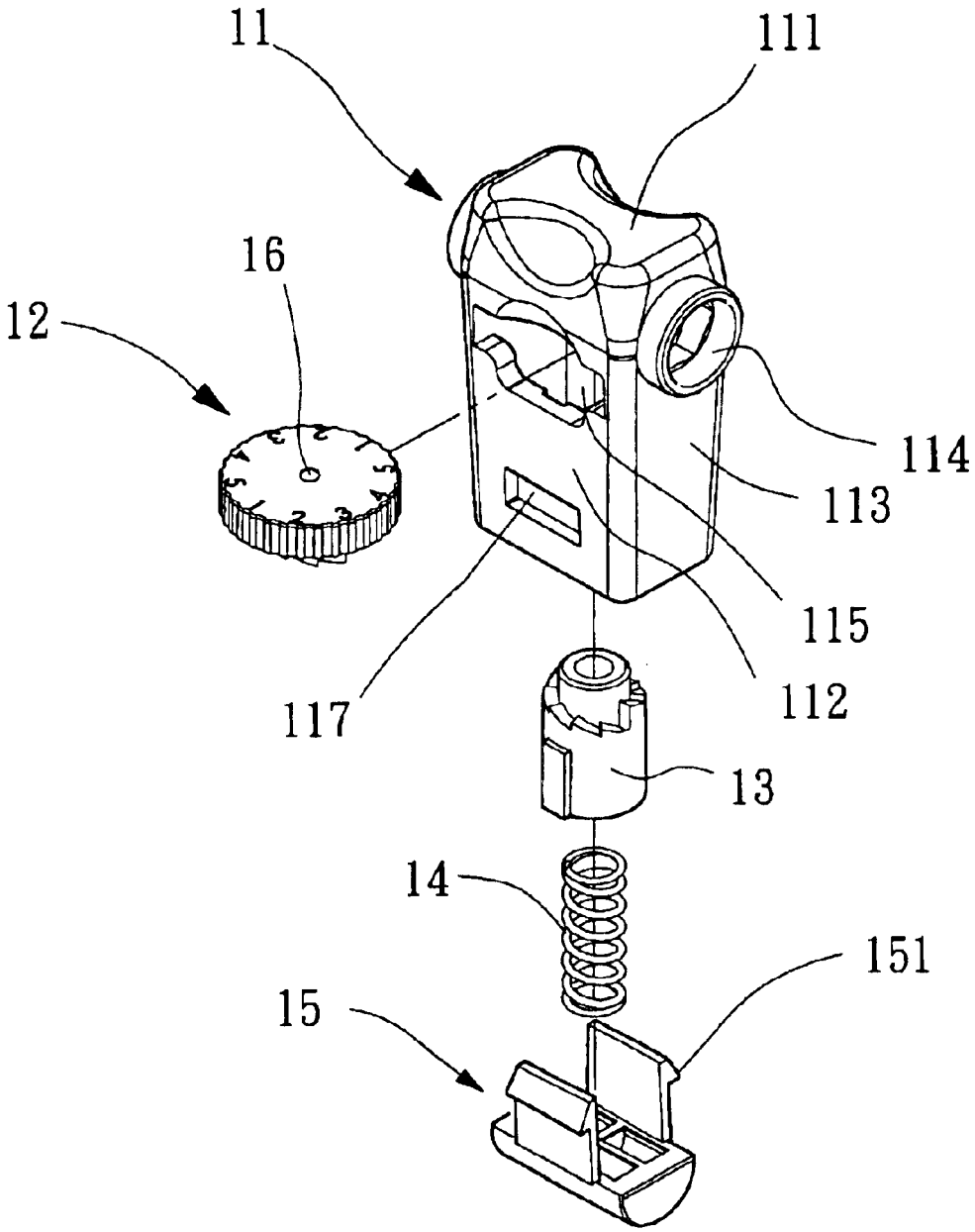
FIG. 7 is an exploded view of an alternate form of the sheet member impression device according to the present invention.
Figure 8:
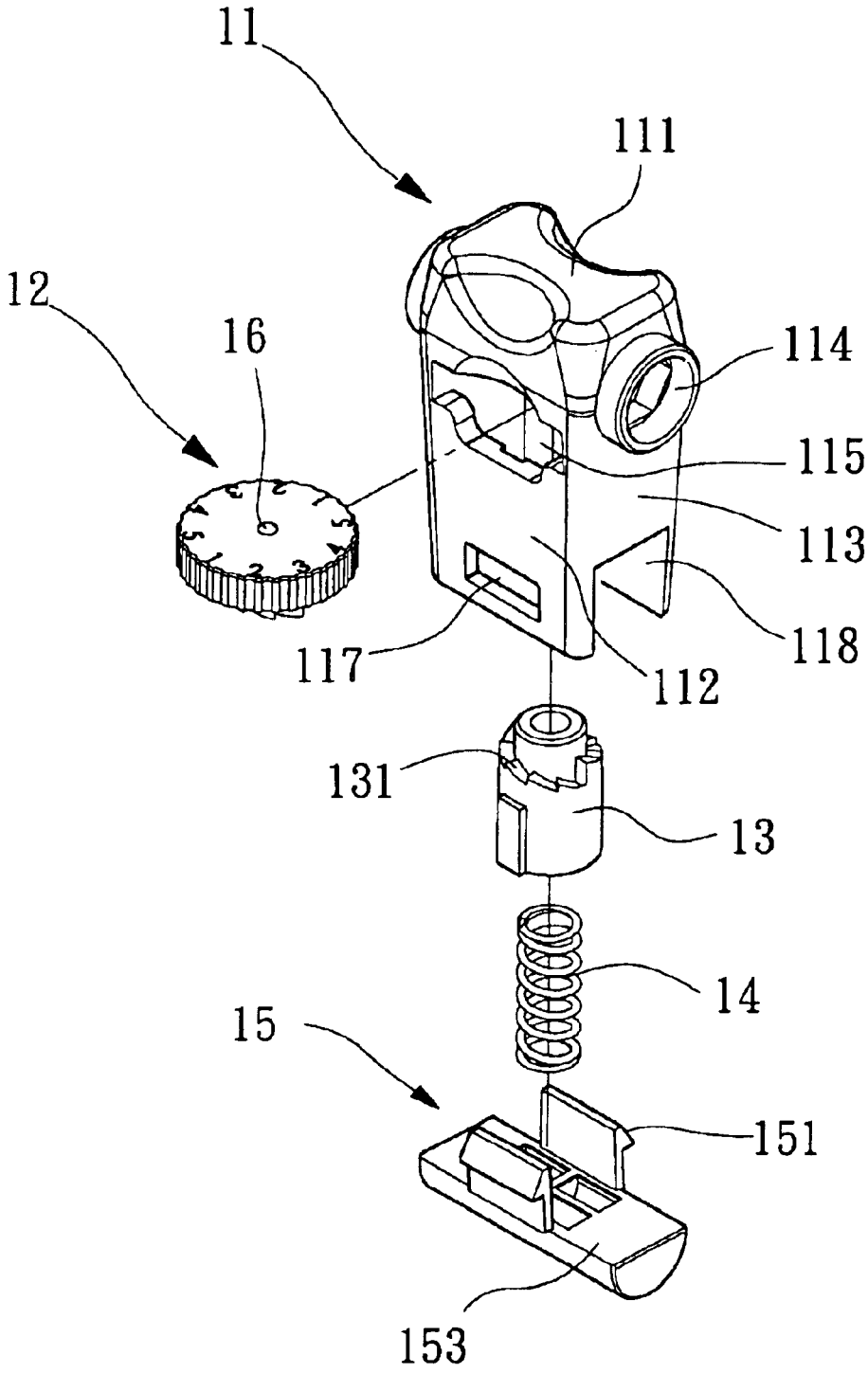
FIG. 8 is an exploded view of another alternate form of the sheet member impression device according to the present invention.

The aforesaid coupling holes 117 may be respectively formed in the two opposite vertical lateral sidewalls 113 of the casing 11 (see FIGS. 2~5), or the two opposite vertical faces 112 of the casing 11 (see FIGS. 7 and 8).

Referring to FIG. 8, the bottom contact wall 152 of the press member 15 may be made having two extension portions 153 respectively outwardly extended from the two ends thereof in reversed direction, increasing the contact area between the press member 15 and the pressure board 4. According to the embodiment shown in FIG. 8, the casing 11 has two side openings 118 respectively formed in the two opposite vertical lateral sidewalls 113 at the bottom side for the passing of the extension portions 153 of the bottom contact wall 152 of the pres member 15.

Figure 9:
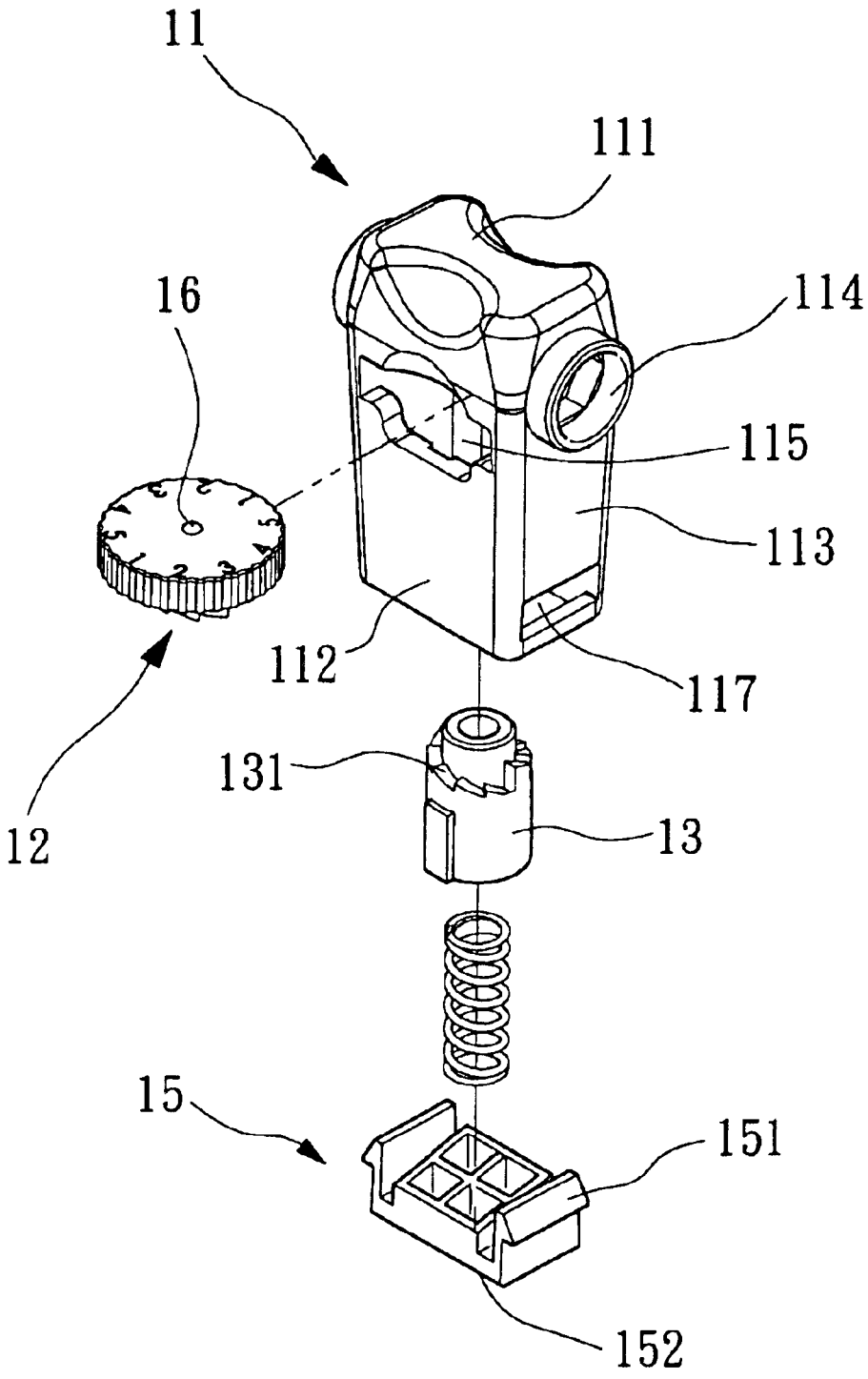
FIG. 9 is an exploded view of another alternate form of the sheet impression device according to the present invention.

Referring to FIG. 9, the he bottom contact wall 152 of the pres member 15 can be a flat contact wall instead of the aforesaid cambered surface.

When in use, the user can move each sheet member impression device 1 along the rod member 2 to shift the retaining device (spring-supported steel ball) 16 from one locating hole 21 to another, adjust the pitch between the sheet member impression devices 1 as desired. Because the contact between the contact portion 152 of the press member 15 of each sheet member impression device 1 and the pressure board 4 is a line contact, downward pressure is evenly applied from the sheet member impression devices 1 to the pressure board 4 to keep the transferring sheet member 5 smooth.

A prototype of sheet member impression device has been constructed with the features of FIGS. 2~9. The sheet member impression device functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A sheet member impression structure comprising a rod member, and two sheet member impression devices mounted on said rod member and respectively pressed on a pressure board to smooth a sheet member being transferred beneath said pressure board, said sheet member impression devices each comprising:

a casing mounted on said rod member, said casing comprising an inside space, two through holes aligned at two sides in communication with said inside space and adapted to accommodate said rod member, a side opening, and a bottom hole;

an adjustment unit mounted in said inside space inside said casing below said rod member and partially extended out of the side opening of said casing for operation by the user to adjust the position of said casing on said rod member;

a spring member mounted in said inside space inside said casing below said adjustment unit; and a press member mounted in said inside space inside said casing and supported on a bottom side of said spring member and partially extended out of the bottom hole of said casing and forced by said spring member to press on said pressure board.

2. The sheet member impression structure as claimed in claim 1, wherein said rod member has a plurality of locating holes longitudinally aligned in a line for the positioning of said sheet member impression devices selectively.

3. The sheet member impression structure as claimed in claim 1, wherein said adjustment unit comprises a first adjustment wheel mounted in said inside space inside said casing and partially extended out of the side opening of said casing for turning by the user, said first adjustment wheel having a bottom ratchet, and a second adjustment wheel mounted in said inside space inside said casing below said first adjustment wheel, said second adjustment wheel being a hollow wheel having a top ratchet meshed with the bottom ratchet of said first adjustment wheel.

4. The sheet member impression structure as claimed in claim 3, wherein said first adjustment wheel comprising a retaining unit located on a top side thereof and adapted to selectively engage one said locating hole of said rod member.

5. The sheet member impression structure as claimed in claim 3, wherein said first adjustment wheel has an embossed peripheral wall.

6. The sheet member impression structure as claimed in claim 3, wherein said first adjustment wheel has signs marked on a top surface thereof around the periphery.

7. The sheet member impression structure as claimed in claim 1, wherein said spring member is a compression spring.

8. The sheet member impression structure as claimed in claim 1, wherein said spring member is a continuously S-shaped spring leaf.

9. The sheet member impression structure as claimed in claim 1, wherein said casing comprises two coupling holes symmetrically disposed at two sides for receiving said press member.

10. The sheet member impression structure as claimed in claim 9, wherein said press member comprises two coupling portions respectively loosely coupled to said coupling holes of said casing, and a bottom contact wall disposed in contact with said pressure board.

11. The sheet member impression structure as claimed in claim 10, wherein said bottom contact wall comprises two extension portions respectively extended from two ends thereof in reversed directions and disposed in contact with said pressure board.

12. The sheet member impression structure as claimed in claim 11, wherein said casing has two side openings in communication with said bottom hole for the passing of the extension portions of said bottom contact wall.

13. The sheet member impression structure as claimed in claim 10, wherein said bottom contact wall is a camfered surface.

14. The sheet member impression structure as claimed in claim 10, wherein said bottom wall is a flat surface.

* * * * *